US008293157B2

(12) United States Patent
Yamada et al.

(10) Patent No.: US 8,293,157 B2
(45) Date of Patent: Oct. 23, 2012

(54) METHOD OF MANUFACTURING CELLULOSE/GELATIN COMPOSITE VISCOSE RAYON FILAMENT

(75) Inventors: Masaru Yamada, Neyagawa (JP); Kunihiro Ohshima, Neyagawa (JP)

(73) Assignee: Kurashiki Boseki Kabushiki Kaisha, Kurashiki-Shi (JP)

( * ) Notice: Subject to any disclaimer, the term of this patent is extended or adjusted under 35 U.S.C. 154(b) by 247 days.

(21) Appl. No.: 11/989,392

(22) PCT Filed: May 10, 2006

(86) PCT No.: PCT/JP2006/309413

§ 371 (c)(1),
(2), (4) Date: Jan. 25, 2008

(87) PCT Pub. No.: WO2007/015327

PCT Pub. Date: Feb. 8, 2007

(65) Prior Publication Data

US 2009/0166919 A1 Jul. 2, 2009

(30) Foreign Application Priority Data

Aug. 3, 2005 (JP) ..... 2005-225644

(51) Int. Cl.
*D01F 2/08* (2006.01)

(52) U.S. Cl. ..... 264/191; 264/211.24

(58) Field of Classification Search ..... 264/188, 264/191, 211.24
See application file for complete search history.

(56) References Cited

U.S. PATENT DOCUMENTS

| | | | | |
|---|---|---|---|---|
| 4,158,698 | A * | 6/1979 | Geyer et al. | 422/189 |
| 5,482,776 | A * | 1/1996 | Nishiyama et al. | 428/400 |
| 6,514,610 | B2 * | 2/2003 | Itoyama et al. | 428/372 |
| 7,022,200 | B2 * | 4/2006 | Tayebi | 156/180 |
| 2005/0277568 | A1 * | 12/2005 | Keenan et al. | 510/438 |

FOREIGN PATENT DOCUMENTS

| | | | |
|---|---|---|---|
| JP | 35-11458 | B2 | 8/1960 |
| JP | 38-18563 | B2 | 9/1963 |
| JP | 2001-3223 | A | 1/2001 |
| JP | 2004-149953 | A | 5/2004 |
| JP | 2005-163204 | A | 6/2005 |
| WO | WO-2005/054553 | A1 | 6/2005 |

OTHER PUBLICATIONS

Minoru Itaya, Sen-I Gakkaishi, "Study on the Viscose Fiber Grafted With Milk Casein". vol. 25, No. 6 (1969), p. 24 to p. 34, pp. 286-296.
Indian Office Action issued on May 26, 2011 for corresponding application No. 553/CHENP/2008.

* cited by examiner

*Primary Examiner* — Yogendra Gupta
*Assistant Examiner* — Ninh Le
(74) *Attorney, Agent, or Firm* — Birch, Stewart, Kolasch & Birch, LLP

(57) ABSTRACT

A method of manufacturing a cellulose/gelatin composite viscose rayon filament that is characterized by including a process in which a spinning process is carried out while a viscose spinning solution is mixed with a gelatin crosslinking solution, which makes it possible to produce a cellulose/gelatin composite viscose rayon having uniform strength and elongation without yarn disconnection.

6 Claims, 3 Drawing Sheets

METHOD OF MANUFACTURING CELLULOSE/GELATIN COMPOSITE VISCOSE RAYON FILAMENT

TECHNICAL FIELD

The present invention relates to a cellulose/protein composite viscose rayon filament, and more specifically concerns a method of manufacturing a cellulose/gelatin composite viscose rayon filament and a cellulose/protein composite viscose rayon filament manufactured by such a method.

BACKGROUND ART

Typically, a viscose rayon fiber is manufactured by allowing a material pulp to react with alkali and carbon disulfide and dissolving the resulting matter in sodium hydroxide as alkali xanthate so that a spinning process is carried out with the cellulose being coagulated and regenerated.

The regenerated cellulose fiber typically represented by such viscose rayon has been used desirably for a long time as an artificial fiber having features close to natural fibers, such as a superior hygroscopic property. In order not only to prepare a fiber having features close to cotton or used as a substitute for natural fibers, but also to add new features thereto, various attempts have been made.

With respect to the modifying method for rayon, conventionally attempts to mix natural protein or a protein derivative into viscose and carry out a spinning process to produce a blended fiber have been made for a long time. The objective of these attempts is to allow the cellulose to have animal-based properties, and consequently to provide the viscose fiber with a dyeing property like that of dyes for wool and texture like that of wool. In this case, however, when protein is mixed in viscose, the protein is hydrolyzed by its strong alkaline property to make its own spinning original solution unstable, making it difficult to carry out a practical production in a uniform, stable manner.

In order to solve the above problem, a fiber in which protein (milk casein) is chemically bonded to cellulose has been proposed (Non-Patent Document 1). In this Non-Patent Document 1, a reaction product between milk casein and epichlorohydrin is mixed in viscose, and the cellulose is graft-polymerized by milk casein through epichlorohydrin by utilizing the high alkaline property of the viscose, and a detailed examination is made so as to carry out a spinning process in the middle of the reaction. In this case, however, the spinning original solution is gelatinized by the successively produced graft polymer to make the spinning process impossible, or to cause an insufficient dissolution of casein itself unless the alkali concentration is raised. Moreover, this problem also causes the hydrolysis of protein to accelerate and progress to an amino acid level, with the result that a severe limitation to the reaction time is required, making it difficult to carry out a practical production in a uniform, stable manner.

Attempts have also been made to modify protein into a resin-like material by utilizing a compound, such as acrylnitrile, acrylamide, ethylenediamine and melamine (see Patent Documents 1 and 2). In these methods, protein is only allowed to become one component forming the resin, and is modified greatly. In these cases also, a substantial amount of alkali has to be used for dissolving or dispersing the selected protein (casein) in the same manner as the above-mentioned process. Moreover, upon modifying into a resin-like material, the viscosity needs to be controlled to cause very complicated processes, failing to provide a practical production.

A technique has been proposed in which protein to be blended is mixed into cellulose without causing deterioration such as a reduction in the molecular weight of protein to that of oligomers or amino acids due to influences such as hydrolysis strongly exerted during manufacturing processes (Patent Document 3). In Patent Document 3, wool protein is skillfully adjusted so as to be alkali soluble and acidically coagulated, and the protein is preliminarily subjected to a crosslinking treatment by using a crosslinking agent so that the protein is not dissolved even in an alkaline spinning original solution. However, although the technique of Patent Document 3 is suitable for production of staple fibers, when it is applied to production of filaments in which protein as its yarn state is coagulation-regenerated and used for a long time up to the last process, it becomes difficult to produce filaments having uniform fineness and strength, and the problems of yarn disconnection and the like are also caused; consequently, this technique is not suitable for the production of filaments. Moreover, since the technique of Patent Document 3 needs to separately acquire specific protein components that are alkali soluble and acidically coagulated, another problem is the resulting high manufacturing costs.

Patent Document 1: Japanese Patent Application Publication Sho. 35-11458

Patent Document 2: Japanese Patent Application Publication Sho. 38-18563

Patent Document 3: Japanese Patent Application Laid-Open No.

Non-Patent Document 1: SEN-I GAKKAISHI, 1969, Vol. 25, p(24) to p(34), P 286 to P296

DISCLOSURE OF INVENTION

Problems to be Solved by Invention

The present invention has been made to solve the above-mentioned problems, and its objective is to provide a method of manufacturing a cellulose/protein composite viscose rayon filament, which can manufacture an uniform filament (in fineness and physical properties) without causing any yarn disconnection.

Means to Solve Problems

The present invention relates to a method of manufacturing a cellulose/gelatin composite viscose rayon filament that is characterized by including a process in which a spinning process is carried out while a viscose spinning solution is mixed with a gelatin crosslinking solution.

Effects of Invention

The manufacturing method of the present invention makes it possible to continuously manufacture a cellulose/gelatin composite viscose rayon filament that is uniform in strength and elongation.

The cellulose/gelatin composite viscose rayon filament, obtained by the manufacturing method of the present invention, is allowed to exert functions, such as dyeing property, shape stability, heat retaining property, formaldehyde-adsorbing property, deodorizing property, ultraviolet-ray blocking property and pH buffering function, which are features derived from protein-based fibers typically represented by wool fibers, in addition to original features of regenerated cellulose fibers.

DESCRIPTION OF REFERENCE NUMERALS

Figure 1:
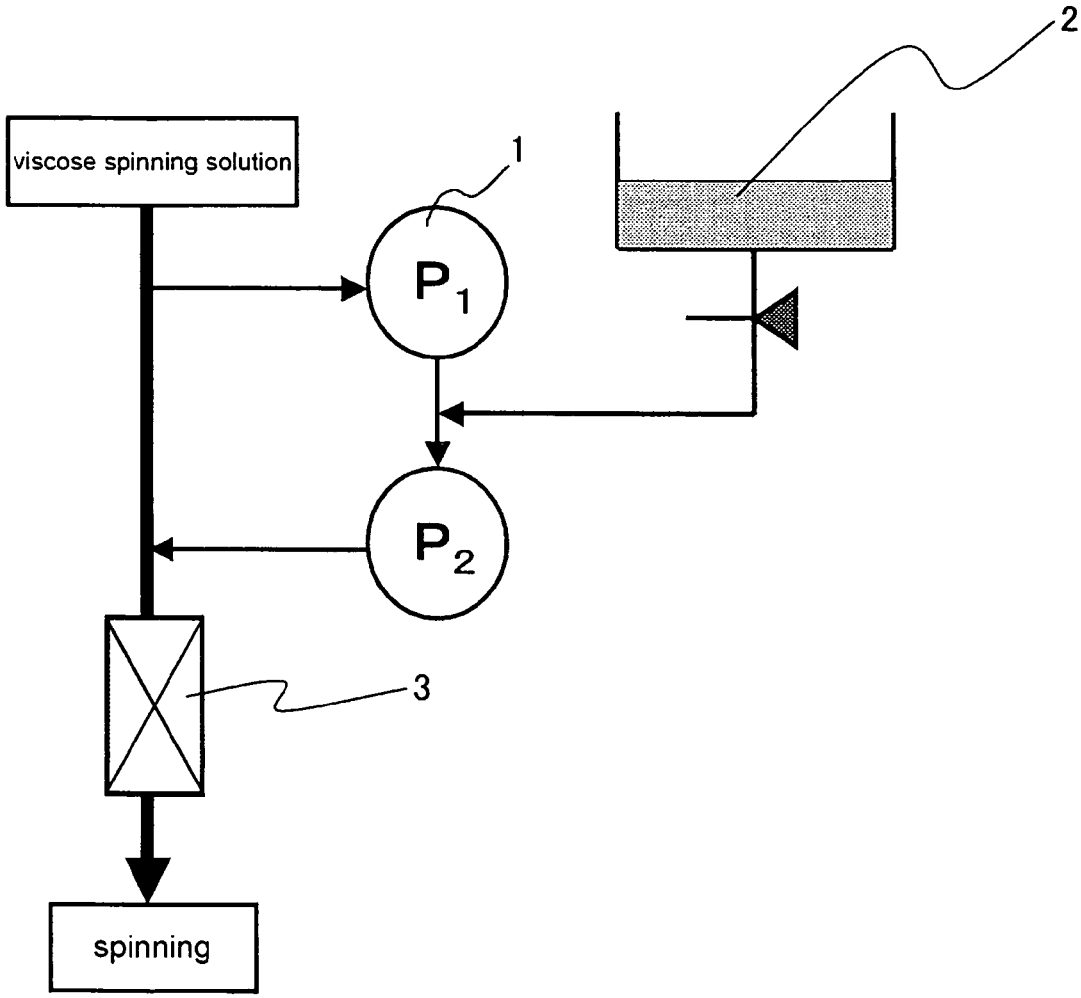
FIG. 1 is a drawing that schematically explains processes used in a mixing method of a viscose spinning solution and a gelatin crosslinking solution.

| | |
|---|---|
| 1 | Gear pump |
| 2 | Gelatin crosslinking solution |
| 3 | Inline mixer |

BEST MODE FOR CARRYING OUT THE INVENTION

In the present invention, the viscose spinning solution is a solution prepared by dissolving cellulose xanthate $(C_6H_9O_4.OCS_2Na)_n$ in an aqueous solution of sodium hydroxide. Prior to supplying to the spinning process, the solution may be subjected to filtering, defoaming and aging processes, which have been conventionally carried out. The cellulose xanthate may be prepared through a conventional method of manufacturing. The viscose spinning solution used in the present invention is normally prepared as a solution composed of alpha cellulose (7 to 10%), NaOH (4 to 7%) and carbon disulfide (25 to 35%).

The gelatin crosslinking solution used in the present invention is a solution prepared by adding a crosslinking agent to a gelatin aqueous solution. The crosslinking agent is firmly covalent-bonded with gelatin so that when mixed with viscose, a hydrolysis-suppressing effect of gelatin by alkali is exerted. Moreover, the reaction group of the residual crosslinking agent is expected to be bonded to a hydroxide group of cellulose.

With respect to gelatin produced in the industrial scale, materials thereof are mainly composed of bovine bones, bovine skins and swine skins. Among these materials, the parent substance to be converted into gelatin is protein referred to as collagen. Although collagen is a hardly soluble substance, when this is treated with an acid and an alkali and then heated, its molecular structure having three helical chains is broken and separated into three molecules at random. The thermally-modified and solubilized collagen is referred to as gelatin. Normally, commercially available gelatin has a molecular-weight distribution in a range from several tens of thousands to several millions.

In the present invention, gelatin having a number-average molecular weight in a range from several thousands to several tens of thousands, preferably from 9000 to 60000, more preferably from 18000 to 35000, is used. The smaller the molecular weight becomes, the worse the protein yield (residual rate of protein) in fibers becomes, with the result that the functionality to be obtained by compounding protein is also lowered. In contrast, the greater the molecular weight becomes, the more easily the gelation occurs, making it difficult to carry out spinning and manufacturing processes of a target cellulose/gelatin composite viscose rayon filament.

Gelatin changes its phases in a gelatin solution from gel to sol as well as from sol to gel, when heated or cooled, and also has the feature that these sol-gel changes occur at a temperature close to normal temperature in a reversible manner. Gelatin, which is a thermally-modified substance from collagen, has a molecular structure in a random coil state in a heated solution. When this solution is cooled, one portion of the gelatin molecules is allowed to have the spiral structure of the original collagen to form a network, finally losing the flowability to form gel. For this reason, the higher the molecular weight becomes, the more easily the gelatin is gelled, resulting in a failure to produce a homogeneous composite filament, as well as making it difficult to carry out the spinning process. These problems can be solved by using the gelatin having the above-mentioned molecular weight. In the present invention, the number-average molecular weight is indicated by a value measured through high-performance liquid chromatography.

The molecular weight of gelatin is adjusted by subjecting gelatin generally purified with a molecular weight distribution from several tens of thousands to several millions to a hydrolysis by using an appropriate proteolytic enzyme (for example, serine protease)(proteolytic enzyme method). With respect to the conditions of decomposition, to an aqueous solution or a suspension containing 1 to 10% by weight of gelatin is added about 0.5 to 10 g/L of a proteolytic enzyme, and this is allowed to react at about 40° C. for 1 to 10 hours. The degree of decomposition can be monitored based upon the gel strength and viscosity indicated by JIS K6503. The hydrolyzed gelatin is condensed to form a gelatin solution of 10 to 60% by weight. In the case when, after the hydrolysis, the resulting gelatin is successively reacted with a crosslinking agent continuously, the concentrating process of gelatin is carried out so that the concentration thereof is set in a range from 10 to 20% by weight. In the case when the hydrolyzed gelatin solution is transported or stored, the concentration thereof is set in a range from 30 to 50% from the viewpoints of transporting costs and easiness of dilution in the crosslinking process.

In the proteolytic enzyme method, after the completion of decomposition, it is necessary to inactivate the enzyme. Hydrogen peroxide may be used as the inactivating agent or a thermal treatment may be carried out. For example, hydrogen peroxide can be blended at 200 to 1000 ppm. Hydrogen peroxide, which has an antiseptic function, is preferably used. By using hydrogen peroxide as a deactivating agent and by storing the gelatin solution in its tightly sealed state, the gelatin solution can be kept for a long time (at least one year) in a stable manner.

With respect to the gelatin aqueous solution used in the present invention, a gelatin aqueous solution of 35 to 45% by weight is adjusted so as to have an actual solution gel point in a range from 15° C. to 35° C., and this solution is used. This range is determined based upon the fact that the spinning mixture to be carried out in the manufacturing method of the present invention is carried out under a temperature environment from 19 to 20° C., as well as based upon the gelatin concentration to be adjusted upon blending in association with the amount of addition per cellulose. Here, the actual solution gel point refers to a temperature at which the gelation is initiated at the concentration of the condensed solution after the hydrolysis. In general, the gel point becomes higher as the molecular weight becomes greater and as the solid component concentration of gelatin becomes higher. By using the gelatin molecular weight in the above-mentioned range, the actual solution gel point can be easily adjusted in the above-mentioned range. When the actual solution gel point becomes too high, problems arise in the following crosslinking process and the like. In contrast, when the actual solution gel point is low, the molecular weight of gelatin becomes virtually smaller, failing to obtain sufficient effects derived from gelatin combination as protein.

The crosslinking agent added to the gelatin aqueous solution reacts with active hydrogen atoms of gelatin so that the gelatin is crosslinked, and after mixing in a viscose spinning solution, partially remaining reaction groups are allowed to react with cellulose so that the gelatin and the cellulose are chemically bonded through the crosslinking agent.

Examples of the crosslinking agent include: formaldehyde, gultaric aldehyde, N-methylol compound, divinylsulfone-based compound, vinylsulfonium compound, polyfunctional acryloylated compound, triazine compound, epoxy compound and halohydrin compound. More preferably, a water-soluble epoxy compound having two or more epoxy groups in one molecule is used, and in the present invention, the water-soluble epoxy compound having two or more epoxy groups in one molecule is effectively used. Specific examples thereof include: ethylene glycol diglycidyl ether, diethylene glycol diglycidyl ether, glycerol polyglycidyl ether, polyglycerol polyglycidyl ether, polyethylene glycol diglycidyl ether, propylene glycol diglycidyl ether, dipropylene glycol diglycidyl ether and polypropylene glycol diglycidyl ether. With respect to commercial products, diethylene glycol diglycidyl ether "Denacol EX-851" (made by Nagase Chemtex Corporation) and glycerol polyglycidyl ether "Denacol EX-313" (made by Nagase Chemtex Corporation) are available.

With respect to the amount of addition of the crosslinking agent, although not generally specified since it differs depending on the molecular weight and the functional group equivalent, it is preferably set to 10 to 50% by weight per gelatin solid component in the case of the above-mentioned Denacol EX851 and Denacol EX313. In order to avoid phase change in gelatin due to the outside temperature and also to accelerate the crosslinking reaction uniformly, the crosslinking process is preferably carried out in a temperature range from 40 to 50° C., and when the gelatin concentration as a whole is adjusted in a range from 10 to 20% by weight by adding hot water thereto, the succeeding mixing process with a viscose spinning solution is conveniently carried out. The pH of the crosslinking process is preferably set to about 10. When pH is too low, the crosslinking reaction hardly progresses, and there is also a risk of gelation of gelatin. When pH is too high, there is a risk of alkali hydrolysis of gelatin.

The gelatin crosslinking solution used in the present invention is effectively preserved in a stable manner at about room temperature of 20° C., and no changes in the solution state are seen even after a week or so, and surprisingly, each time it is mixed and blended in a viscose spinning solution, a cellulose/gelatin composite viscose rayon filament is successively produced.

The viscose spinning solution and the gelatin crosslinking solution are subjected to a spinning process while being mixed with each other. In other words, the two solutions are mixed immediately before the spinning of a filament. A master-batch method in which a mixed solution between the viscose spinning solution and the gelatin crosslinking solution is preliminarily formed may also be used; however, in this case, the mixed solution should be consumed within 5 to 20 hours. After a lapse of time exceeding this range, a phase separation might occur in the viscose. This is presumably because decomposed gelatin due to caustic alkali and epoxy groups that have not been consumed by the crosslinking reaction of gelatin also cause a partial interaction to hydroxide groups of the cellulose due to high alkaline property, insufficient stirring and lapse of time.

The mixing ratio between the viscose spinning solution and the gelatin crosslinking solution is set to 5 to 50% by weight of gelatin, preferably 15 to 35% by weight, with respect to cellulose, upon conversion to solid-state components. When the mixing ratio is too low, the effects of combining gelatin with cellulose are not sufficiently obtained. In contrast, when the mixing ratio is too high, it becomes difficult to carry out the spinning process itself due to yarn disconnection and the like, resulting in degradation in mechanical properties of the resulting fiber.

It is considered that, immediately after the spinning of a filament, an appropriate delay of coagulation in the viscose takes place due to the function of gelatin protein and ethylene oxide of the crosslinking agent, and that the absorbing rate of zinc in the coagulant solution increases due to protein (gelatin); therefore, uniform coagulating and regenerating processes are carried out. Consequently, a cellulose/gelatin composite viscose rayon filament is produced. With respect to processes after the spinning process, the same processes as conventional processes, such as a winding-up process to a cake, neutralizing and bleaching processes and a drying process, are carried out. Normally, the spinning rate is set to about 60 to 100 m/min so that a cellulose/gelatin composite viscose rayon filament can be manufactured. Not limited to the method using a wet process in which a cake is applied, the present invention may be applied to a continuous wet process using a reel (also referred to as continuous spinning process).

Various fiber products (for example, yarn, cloth (woven fabric, knit fabric, etc.) can be manufactured by using the cellulose/gelatin composite viscose rayon filament produced by the manufacturing method of the present invention, and those products are also included in the scope of the present invention.

The following description will discuss the present invention by means of examples. In the examples, "%" refers to "% by weight" unless otherwise indicated.

EXAMPLES

Example 1

Gelatin was extracted through a conventionally-used method by using bovine bones as materials (immersed in 4% hydrochloric acid for two days, washed with water, immersed in lime water of pH 12.5 for 20 days, washed by water, hot water poured therein, and extracted through a batch method). This was purified through a conventionally-used method (the extracted gelatin was filtered through a cotton filter, and impurities such as metal ions were removed therefrom by using an ion exchange resin).

Proteolytic enzyme (serine protease) was allowed to react with the gelatin thus extracted and purified to be hydrolyzed, and various hydrolyzed gelatins were produced while changing the processing time while monitoring the gel strength in accordance with JIS K6503. The respective gelatin solutions were condensed and deactivated by using an aqueous solution of hydrogen peroxide. The resulting various gelatin solutions were heated at 110° C., and moisture was evaporated for 5 hours so that the solid component concentration thereof was measured by using the weighing method. Each of them had a solid component concentration of 40±2% (shown in Table 2). The number-average molecular weights of the respective gelatins obtained through high-performance liquid chromatography were 50000, 26000, 18000 and 6000, respectively.

The actual solution (40% solution) gel points of the resulting gelatin solutions are shown in Table 1.

Data converted to the amount of protein from values obtained by nitrogen-analyses through Kjeldahl method are shown in Table 2.

TABLE 1

| No. | Number average molecular weight | Actual solution gel point (° C.) |
|---|---|---|
| A | 50000 | 34.5 |
| B | 26000 | 25.5 |
| C | 18000 | 21.0 |
| D | 6000 | 10.0 or less |

Example 2

A gelatin solution of No. A prepared in example 1 (20 Kg) was loaded into hot water (20 Kg) temperature-adjusted to 45° C., and stirred to obtain a gelatin dissolved solution. To the gelatin dissolved solution was added 50% sodium hydroxide to adjust pH to 10. After having confirmed that an uniform solution was prepared, a water-soluble polyfunctional aliphatic epoxy compound (Denacol EX851 (made by Nagase Chemtex Corporation))(2 Kg) was put into the solution in 30 minutes, and this was stirred for 3 hours. The temperature adjustment was stopped, and the solution was gradually cooled. A gelatin crosslinked solution A containing 19% by weight of gelatin was obtained.

Example 3

The same processes as those of example 2 were carried out except that a gelatin solution of No. B prepared in example 1 was used so that a gelatin crosslinked solution B containing about 19% by weight of gelatin was obtained.

Example 4

The same processes as those of example 2 were carried out except that a gelatin solution of No. C prepared in example 1 was used so that a gelatin crosslinked solution C containing about 19% by weight of gelatin was obtained.

Example 5

The same processes as those of example 2 were carried out except that a gelatin solution of No. D prepared in example 1 was used so that a gelatin crosslinked solution D containing about 19% by weight of gelatin was obtained.

Example 6

To a viscose spinning solution prepared through a conventionally-used method (alpha cellulose 8.3%, NaOH 5.7%, carbon disulfide 32%) was mixed a gelatin crosslinking solution immediately before the spinning of the filament by using an inline mixer (T.K. pipeline homomixer; made by Tokushu Kika Kogyo Co., Ltd.) so that the amount of addition of gelatin was set to 20% (solid component) with respect to cellulose (that is, 870.4 g of the gelatin crosslinking solution A with respect to 10 Kg of the viscose spinning solution). FIG. 1 shows schematic processes of the mixing method between the viscose spinning solution and the gelatin crosslinking solution. One portion of the viscose spinning solution was taken in by using a gear pump P1, and the gelatin crosslinking solution was inserted between gear pumps P1 and P2 so that a mixed solution was sent to the inline mixer by the gear pump P2. The mixed solution, sent by the gear pump P2, was uniformly mixed with the viscose spinning solution that had not been taken in by the gear pump P1 by the inline mixer. The mixed solution was sent to a spinning nozzle, and spun into a filament at a spinning rate 85 m/min with 210 g/L of sodium sulfide, 115 g/L of sulfuric acid and 30 g/L of zinc sulfide (Muller bath). With respect to a spinning nozzle, four spindles with pores for 120D/30F (pore diameter of 1F: 0.08 mm) were used. The filament was wound up onto a cake through the spinning bath, and was subjected to wet-type coagulating and regenerating processes through a batch system and a drying process so that a target filament was manufactured.

The spinning operation was conducted for 10 hours per day, and the operation was repeated for seven days. Here, the gelatin crosslinking solutions A to D were prepared at the time of starting the operation, and stored to be used.

The spinning operation was successfully carried out over the entire period of seven days so that the filament was obtained without any trouble.

The nitrogen content of the resulting filament was measured by Kjeldahl method. The results are shown in the following Table 2. The total nitrogen content (% by weight) was obtained through measurements in which the filament was high-temperature decomposed with concentrated sulfuric acid, and water-vapor-distilled so that the nitrogen content was measured as ammonia; therefore, no nitrogen to form ammonia was contained in normal viscose in its materials and production processes. No nitrogen was contained in the crosslinking agent used in the present invention. Here, in Table 2, the nitrogen content of gelatin in each of the gelatin solutions A to D was measured, and the measured value was also listed. The total nitrogen (% by weight) obtained in each of the gelatin solutions A to D through Kjeldahl method represents the nitrogen content of the protein gelatin solution.

Fineness based on corrected weight (dtex), dry strength (cN/dtex), wet strength (cN/dtex) and elongation rate (%) of each of the obtained filaments ($1^{st}$ day, $3^{rd}$ day, $5^{th}$ day, $7^{th}$ day) were respectively measured. The results are shown in Table 3.

These data correspond to values obtained by measurements in accordance with JIS L1013 (grabbing distance 20 cm, pulling rate 20 cm/min), which represent characteristics forming substantial scales for mechanical properties of the fiber. Rate of shrinkage is also shown in Table 3.

Example 7

The same processes as those of example 6 were carried out except that gelatin crosslinking solution B was used to manufacture a filament, and the filament was evaluated. The results are shown in the following Tables 2 and 3.

Example 8

The same processes as those of example 6 were carried out except that gelatin crosslinking solution C was used to manufacture a filament, and the filament was evaluated. The results are shown in the following Tables 2 and 3.

Example 9

The same processes as those of example 6 were carried out except that gelatin crosslinking solution D was used to manufacture a filament, and the filament was evaluated. The results are shown in the following Tables 2 and 3.

Comparative Example 1

The same processes as those of example 2 were carried out except that gelatin of a commercial reagent (made by Wako Pure Chemical Industries, Ltd.) was used as the gelatin in an attempt to manufacture a gelatin crosslinking solution.

That is, gelatin (1 Kg) (solid component: moisture content 5%) was loaded into 4 Kg of hot water (45° C.), and stirred therein. Since the gelatin was not completely dissolved to cause a failure to form an uniform solution, 4 Kg of hot water (45° C.) was further added thereto, and continuously stirred. Since the gel-state matter became a considerably small amount, sodium hydroxide was added thereto to adjust pH to 10.

Since there was a fine coagulated matter, the coagulated matter was filtered and removed. The filtering process was carried out through a pressure-filtration by using a non-woven fabric of polyester/cotton; however, the entire amount thereof was not filtered due to clogging. One portion of the filtrate was used to form a crosslinking solution through the sequence of processes of example 2, and in an attempt to produce a filament, the spinning process was carried out in the same manner as example 6. However, no production was available due to many single yarn disconnections. It is considered that the molecular weight of gelatin was too high to cause a failure to obtain an uniform crosslinking solution.

Comparative Example 2

The gelatin crosslinking solution A (870.4 g) prepared in example 2 was mixed in the viscose spinning solution (10 Kg) used in example 6, and this was subjected to a defoaming process for 5 hours. The resulting mixed solution was subjected to the same processes as example 6 except that the mixed solution was directly spun into Müller bath to produce a filament without using the injection system.

For the initial 5 hours from the spinning of the filament, the filament was desirably spun out; however, thereafter, the filament was gradually spun out insufficiently to cause many disconnected yarns, resulting in a failure to form a filament.

Comparative Example 3

The same processes as those of comparative example 2 were carried out by using only the viscose spinning solution, without using the gelatin crosslinking solution, to form a filament. This filament was a conventional viscose filament. This was compared with the filaments of examples, and evaluated. The results are shown in the following Tables 2 and 3.

TABLE 2

Measured value of total nitrogen by Kjeldahl method

| | Total nitrogen (%) | Protein concentration (%) (solid content) |
|---|---|---|
| Gelatin solution A | 6.56 | 41.3 |
| Gelatin solution B | 6.16 | 38.2 |
| Gelatin solution C | 6.32 | 39.9 |
| Gelatin solution D | 6.41 | 40.1 |
| Example 6 (1 day) | 2.45 | — |
| Example 6 (7 days) | 2.48 | — |
| Example 7 (1 day) | 2.41 | — |
| Example 7 (7 days) | 2.42 | — |
| Example 8 (1 day) | 2.47 | — |
| Example 8 (7 days) | 2.48 | — |
| Example 9 (1 day) | 1.49 | — |
| Example 9 (7 days) | 1.47 | — |
| Comparative Example 3 | 0.01 or less | — |

In the above-mentioned Table 2, "total nitrogen (% by weight)" indicates the value measured through Kjeldahl method, and the fact that the value is in a range from 6.16 to 6.56 in gelatin solutions A to D indicates a correlation to the solid component concentration of gelatin (41.3 to 38.2) found from the absolute dried state. Since no nitrogen component exists except for gelatin, the fact that the nitrogen component of the filament is in a range of 2.41 to 2.48% by weight leads to a concentration of gelatin solid component in the order of 15% based upon simple calculations carried out through the relationship between the total nitrogen and the concentration of solid component of each of gelatin solutions A to D.

With respect to gelatin solutions A to D, "protein concentration (%)", shown in Table 2, indicates a rate (% by weight) of the solid component weight (absolute dried weight) occupied in the gelatin solution.

Since the amount of charge of gelatin was set to 20% in solid component per cellulose, the content is given as a simply calculated value of 20/120×100=16.6%. It is predicted that in each of examples 6, 7 and 8, most of the charged gelatin remained as one portion of fibers. In example 9, it is assumed that the molecular weight of gelatin was small with the result that an inferior yield was caused.

TABLE 3

| | Day | Example 6 | Example 7 | Example 8 | Example 9 | Comparative Example 3 |
|---|---|---|---|---|---|---|
| Fineness based | 1 | 119.2 | 118.8 | 119.4 | 117.5 | 118.3 |
| on corrected | 3 | 118.7 | 118.4 | 117.9 | 118.1 | |
| weight | 5 | 119.3 | 117.9 | 118.5 | 117.3 | |
| dtex | 7 | 118.3 | 118.3 | 117.9 | 117.5 | |
| Dry strength | 1 | 1.92 | 1.90 | 1.89 | 1.79 | 2.05 |
| cN/dtex | 3 | 1.89 | 1.93 | 1.88 | 1.72 | |
| | 5 | 1.87 | 1.87 | 1.90 | 1.76 | |
| | 7 | 1.86 | 1.91 | 1.80 | 1.71 | |

TABLE 3-continued

| | Day | Example 6 | Example 7 | Example 8 | Example 9 | Comparative Example 3 |
|---|---|---|---|---|---|---|
| Wet strength | 1 | 0.96 | 1.02 | 1.01 | 1.04 | 1.18 |
| cN/dtex | 3 | 0.98 | 1.01 | 0.96 | 1.08 | |
| | 5 | 0.97 | 0.96 | 0.97 | 1.05 | |
| | 7 | 0.95 | 0.98 | 0.97 | 1.01 | |
| Elongation rate | 1 | 11.0 | 11.1 | 10.9 | 13.2 | 18.5 |
| (%) | 3 | 11.2 | 11.3 | 10.8 | 14.1 | |
| (dry elongation) | 5 | 10.8 | 11.2 | 11.1 | 13.5 | |
| | 7 | 10.9 | 10.9 | 10.5 | 14.2 | |

Middle portion in cake was measured

As shown in the above Table 3, no changes in shape and physical properties (changes to strong elongation) were observed from 1$^{st}$ to 7$^{th}$ day in all the filaments obtained in Examples. This fact also indicates that the gelatin crosslinking solutions were stably maintained for at least seven days, and that no problems were raised in practical use. In comparison with comparative example 3 that corresponds to a conventionally-used rayon filament, no major change was observed in the fineness, indicating that the present invention is applicable under the same spinning conditions. With respect to the strength, although a slight reduction is seen, no problem is raised in practical use. It is considered that the reduction in the elongation rate (dry elongation) was caused by influences from crosslinking between cellulose molecules due to the crosslinking agent; however, since the same reduction is observed also in a crosslinking process to be carried out as a shape-stabilizing process, it is within the assumed range.

In example 7 and comparative example 3, the mechanical properties (fineness based on corrected weight, tensile strength, elongation rate, hot-water shrinkage and dry-heat shrinkage) of the filament in the cake portions (inner layer, middle layer and outer layer) were evaluated in accordance with JIS L1013 (grabbing distance 20 cm, pulling rate 20 cm/min), and the results are shown in the following Table 4.

TABLE 4

| Evaluation item | | Evaluation results | |
|---|---|---|---|
| | | Example 7 (1 day) | Comparative Example 3 |
| Fineness based on | inner layer | 118.6 | 120.7 |
| corrected weight | middle layer | 118.8 | 118.3 |
| (dtex) | outer layer | 119.4 | 116.8 |
| Tensile strength | inner layer | 1.83 | 1.97 |
| (cN/dtex) | middle layer | 1.90 | 2.05 |
| | outer layer | 1.89 | 2.15 |
| Elongation rate | inner layer | 10.8 | 19.8 |
| (%) | middle layer | 11.1 | 18.5 |
| (dry elongation) | outer layer | 11.0 | 18.0 |
| Hot-water shrinkage | inner layer | 0.6 | 0.7 |
| (%) | middle layer | 0.8 | 1.0 |
| boiling water 30 minutes | outer layer | 1.0 | 2.0 |
| Dry-heat shrinkage | inner layer | 0.5 | 0.8 |
| (%) | middle layer | 0.5 | 0.8 |
| 180° C. 30 minutes | outer layer | 0.4 | 0.8 |

Inner, middle and outer layers indicate the portion of cake.

Figure 2:
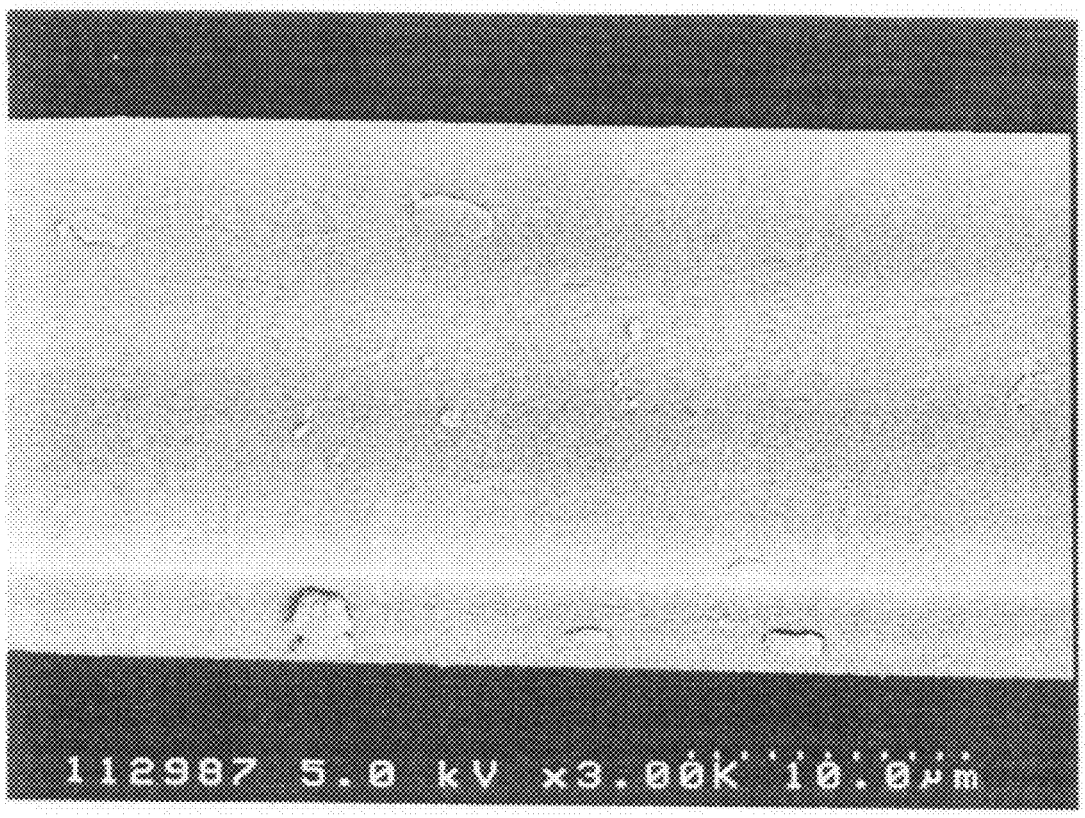
FIG. 2 is an electron microscopic photograph (×3000) that shows a figure of a filament fiber obtained in example 7.
Figure 3:
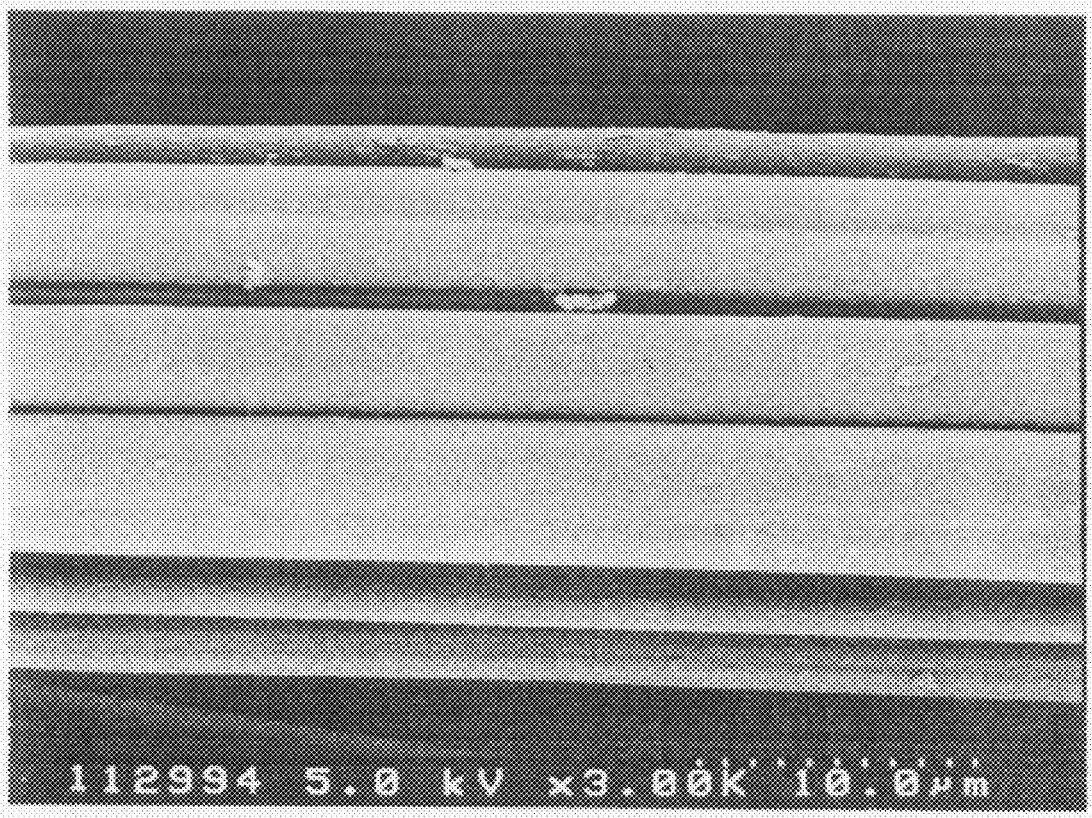
FIG. 3 is an electron microscopic photograph (×3000) that shows a figure of a filament fiber obtained in comparative example 3.

In the rayon filament (comparative example 3), deviations tend to occur in the inner layer, the middle layer and the outer layer due to a tension difference upon winding onto the cake and regenerating behaviors including orientation of molecules. It can be said that the frequency of deviations is smaller in example 7 in comparison with comparative example 3. It is assumed that sulfuric acid and zinc were allowed to smoothly permeate from the coagulated bath with the help of protein and the crosslinking agent blended therein so that well-balanced regenerating process was achieved. FIGS. 2 and 3 show electron microscopic photographs (surface) of filaments obtained in example 7 and comparative example 3. These photographs indicate that although a groove in the skin portion, which would be generated at the time of quick coagulation, was observed in comparative example 3, the groove was disappeared and a specific form was observed in example 7.

In example 7, the reduction in the tensile strength was only a small level in comparison with comparative example 3; in contrast, the elongation rate had a great reduction. It is considered that this fact proves that the filament, obtained by the present invention, has a structure in which cellulose and the crosslinking agent added as a gelatin crosslinking solution are chemically bonded. In fact, the rate of thermal shrinkage of example 7 has a value smaller than that of comparative example 3, and is superior in dimensional stability. It has been generally known that although the formation of crosslinking in cellulose molecules by the use of formalin or the like causes a reduction in elongation, it tends to increase dimensional stability, and the filament obtained by the present invention also has the same tendency.

Example 10

By using the filament formed in example 7, a rib knit product having 14 gages with three yarns doubling was manufactured.

Example 11

By using the filament formed in example 9, a knit product was manufactured in the same manner as example 10.

Comparative Example 4

By using the filament formed in comparative example 3, a knit product was manufactured in the same manner as example 10.

Physical properties of knit fabrics obtained in examples 10 and 11 as well as in comparative example 4 were compared and evaluated.

With respect to the texture of each of the knit fabrics, although that of comparative example 4 had a hand touchness feeling hands peculiar to rayon filaments, those of examples 10 and 11 had soft touch without such a hand touchness feeling hands.

This effect is considered to be obtained because of a difference between fiber shapes as indicated by the electron microscopic photographs of FIGS. 2 and 3 and a combination of protein.

Dyeing Property Test

Each of those knit fabrics was subjected to a conventionally-used rayon dyeing process in the same bath at the same time. Each of them was desirably dyed and no difference was observed with respect to fastness. It was confirmed that the product of the present invention could be dyed in the same manner as a conventional rayon filament without causing any problems.

Each of those knit fabrics was subjected to a dyeing test by using a chrome dye that was generally-used in protein fibers such as wool fibers.

The respective knit fabrics were dyed in the same bath at the same time by using Chrome Black PLW (made by Yamada Chemical Co., Ltd.) (5% owf). The filament of example 10 was dyed into black, the filament of example 11 was dyed into gray, and the filament of comparative example 4 was dyed into faint gray like a contaminated state.

The chrome dye has no dyeing property to cellulose, but dyes protein components. The filament of example 10 was dyed into completely black without irregularities; thus, it is assumed that the protein components are maintained on the fibers in a molecule level. The reason that the filament of example 11 was dyed into gray was presumably because the molecular weight of protein was small with the content thereof being insufficient.

Evaluation of Deodorizing Property

Deodorizing properties (with respect to ammonia gas and formaldehyde gas) of the knit fabrics obtained in examples 10 and 11 as well as in comparative example 4 were compared. The results are shown in Table 5.

The test method for ammonia gas is explained below:

An ammonia gas was filled in a Tedler bag (1 L) containing 1 g of a sample, and the gas concentration inside the Tedler bag was measured by a detector after a lapse of 2 hours as well as after a lapse of 24 hours. The blank test was carried out in the same manner except that no sample was loaded, and the gas concentration was measured.

The test method for formaldehyde gas is explained below:

A sample (1 g) was loaded into a Tedler bag (5 L), and 6 μL of 0.37% formalin/methanol solution was added into the Tedler bag by using a micro-syringe. Fresh air was directed thereto so that the Tedler bag was completely filled so that the formalin/methanol solution was volatilized. The formaldehyde gas concentration inside the Tedler bag was measured by a detector after a lapse of 2 hours as well as after a lapse of 24 hours. The blank test was carried out in the same manner except that no sample was loaded, and the gas concentration was measured.

TABLE 5

| | Ammonia gas concentration (ppm) | | | Formaldehyde gas concentration (ppm) | | |
|---|---|---|---|---|---|---|
| | Initial | 2 hours | 24 hours | Initial | 2 hours | 24 hours |
| Blank test | 152 | 140 | 91 | 2.0 | 1.8 | 1.6 |
| Comparative Example 4 | 152 | 3 | 0.3 | 2.0 | 1.32 | 0.32 |
| Example 10 | 152 | ND*1) | ND | 2.0 | 0.72 | 0.04 |
| Example 11 | 152 | 1 | 0.1 | 2.0 | 1.12 | 0.20 |

*1)"ND" means "no detection"

As clearly indicated by Table 5, the products of the present invention were allowed to exert a deodorizing property higher than that of a conventional rayon filament (comparative example 4) with respect to any of ammonia and formaldehyde. This property is presumably derived from the effects of the incorporated protein (gelatin). The deodorizing property is inherently possessed by protein-based fibers (wool fibers, etc.), and these fibers, which are superior in the ammonia deodorizing property, are desirably used as underwear and bedding materials. The wool carpet, which exerts a purifying function to formaldehyde generated from building materials and furniture, has been desirably used. It can be said that the product of the present invention has both of the properties of cellulose fibers and protein fibers. In comparison with example 10 (using filament of example 7), the molecular weight of incorporated gelatin protein is smaller in example 11 (using filament of example 9), and the total nitrogen content obtained through Kjeldahl method is also smaller therein. Consequently, with respect to physical properties as protein-based fibers, the dyeing property to the chrome dye and the deodorizing property of the resulting product are lowered.

The present invention provides a method of manufacturing a filament that has both of the features of cellulose and protein (gelatin) by using a viscose method.

The manufacturing method of the present invention makes it possible to alleviate changes in physical properties due to a tension difference between cake portions, which have been problems with a conventional viscose filament manufacturing process.

The manufacturing method of the present invention can adopt completely the same spinning, coagulating and regenerating processes as those of the conventional rayon filament, except that the viscose spinning solution is mixed with the gelatin crosslinking solution immediately before the spinning process. Normally, it is rare to use viscose filaments as monofilaments, and for example, filaments are wound around a cake by a unit of several tens of filaments, such as 120D/30F and 75D/24F, and coagulation- and regeneration-controlled. The present invention can be applied simply by attaching a supply system of a protein crosslinking solution immediately in front of the spinning nozzle. The system of the present invention can be carried out partially (on a nozzle unit), while a conventional viscose filament is being produced.

The invention claimed is:

1. A method of manufacturing a cellulose/gelatin composite viscose rayon filament, comprising: a process in which a viscose spinning solution is spun while being mixed with a gelatin crosslinking solution, wherein the viscose spinning solution is mixed with the gelatin crosslinking solution immediately before the spinning of the filament, to continuously mix the viscose spinning solution with the gelatin crosslinking solution and continuously manufacture the cellulose/gelatin composite viscose rayon filament, wherein the method is applied by attaching a supply system of the gelatin crosslinking solution immediately in front of a spinning nozzle to continuously mix the viscose spinning solution with the gelatin crosslinking solution and continuously manufacture the cellulose/gelatin composite viscose rayon filament, wherein the gelatin crosslinking solution is prepared with gelatin having a number-average molecular weight of 9,000 to 60,000, wherein the gelatin is adjusted to a gelatin aqueous solution of 35-45% by weight to obtain an actual solution gel point in a range from 15° C. to 35° C., and wherein the cellulose/gelatin composite viscose rayon filament comprises single fibers having uniform fineness and strength during the continuous manufacture of the cellulose/gelatin composite viscose rayon filament.

2. The manufacturing method according to claim 1, wherein the crosslinking agent is diethylene glycol diglycidyl ether.

3. The manufacturing method according to claim 1, wherein the gelatin has a number-average molecular weight of 18,000 to 50,000.

4. The manufacturing method according to claim 1, wherein the gelatin crosslinking solution is mixed with the viscose spinning solution at a mixing ratio of 5 to 50% by weight of gelatin with respect to cellulose upon conversion to solid-state components.

5. The manufacturing method according to claim 2, wherein the gelatin crosslinking solution is mixed with the viscose spinning solution at a mixing ratio of 5 to 50% by weight of gelatin with respect to cellulose upon conversion to solid-state components.

6. The manufacturing method according to claim 3, wherein the gelatin crosslinking solution is mixed with the viscose spinning solution at a mixing ratio of 5 to 50% by weight of gelatin with respect to cellulose upon conversion to solid-state components.

* * * * *